US005273232A

United States Patent [19]

Mori

[11] Patent Number: 5,273,232

[45] Date of Patent: Dec. 28, 1993

[54] WEFT STAND

[75] Inventor: Kiyoaki Mori, Ishikawa, Japan

[73] Assignee: Tsudakoma Kogyo Kabushiki Kaisha, Kanazawa, Japan

[21] Appl. No.: 890,018

[22] Filed: May 28, 1992

[30] Foreign Application Priority Data

Jun. 11, 1991 [JP] Japan ..... 3-165226

[51] Int. Cl.[5] ..... B65H 49/12

[52] U.S. Cl. ..... 242/131; 139/450

[58] Field of Search ..... 242/131, 131.1, 130, 242/129.5; 139/450, 452

[56] References Cited

U.S. PATENT DOCUMENTS

| | | | |
|---|---|---|---|
| 3,930,623 | 1/1976 | Walden | 242/131 |
| 4,013,243 | 3/1977 | Mayer . | |
| 4,073,450 | 2/1978 | Carlsson et al. | 242/131 |
| 4,815,501 | 3/1989 | Takehana | 139/450 X |
| 4,951,718 | 8/1990 | Shaw | 139/450 |
| 5,012,844 | 5/1991 | Griffith | 139/452 |

FOREIGN PATENT DOCUMENTS

| | | |
|---|---|---|
| 0352852 | 1/1990 | European Pat. Off. . |
| 1068163 | 10/1959 | Fed. Rep. of Germany . |
| 1145527 | 3/1963 | Fed. Rep. of Germany . |
| 2-104745 | 7/1990 | Japan . |

*Primary Examiner*—Stanley N. Gilreath
*Attorney, Agent, or Firm*—Graybeal Jackson Haley & Johnson

[57] ABSTRACT

A weft stand of the present invention comprises a post, a supporting member supported on the post and rotatable about a horizontal axis, a supporting shaft for each weft package, supported on the supporting member and rotatable about an axis in parallel with said horizontal axis, and rotation controlling means for rotating the supporting member and the supporting shaft in the respective opposite directions while maintaining each in directionally constant positions. The weft stand allows the disposition of a weft package, from which a weft is released, in a predetermined direction without providing each supporting shaft with a weft package grasping mechanism.

5 Claims, 4 Drawing Sheets

WEFT STAND

BACKGROUND OF THE INVENTION

1. Field of the Invention

This invention relates to a weft stand for holding a plurality of weft packages for the feed of a weft to a weaving machine.

2. Description of the Prior Art

A conventional weft stand has a supporting member supported on a post for rotation about a horizontal axis. The supporting member is provided with a supporting shaft which is inserted into holes of a plurality of weft packages or trays to support. The respective supporting shafts are disposed so as to form a predetermined angle with respect to the horizontal axis. The horizontal axis is the axis of rotation the supporting member. Accordingly, an axis of the weft package, from which the weft is released, is directed to a yarn guide (see Japanese Patent Public Disclosure (KOKAI) No. 2-104745).

Since the respective supporting shafts are not in parallel with the horizontal axis, the supporting shafts downwardly extend at a certain rotation angle when the supporting member is rotated. Hence, the conventional weft stand should be provided with a weft package grasping mechanism on each supporting shaft to prevent the weft package from slipping off the downwardly extending supporting shafts downwardly extending. However, the weft package grasping mechanism prevents an automatic feed of the weft package to the weft stand and complicates the structure of the weft stand.

SUMMARY OF THE INVENTION

It is an object of the present invention to enable a weft package, from which a weft is released to be oriented in a predetermined direction without providing each supporting shaft with a weft package grasping mechanism.

In the present invention, a weft stand for holding a plurality of weft packages for the feed of a weft to a weaving machine comprises a post, a supporting member supported on the post for rotation about a horizontal axis, a supporting shaft for each weft package, rotatably supported on the supporting member about an axis in parallel with the horizontal axis, and rotation controlling means for rotating the supporting member and the supporting shafts in the respective opposite directions at each identical rotation angle.

According to the present invention, the supporting shaft for the weft package is in parallel with the axis of rotation of the supporting member. Consequently, the direction of the supporting shaft remins unchanged, even if the supporting member is rotated. Therefore, the weft package never slips off the supporting shaft supported by the supporting member. Further, the supporting member and the supporting shafts are controlled so as to be rotated in the respective opposite directions at each identical rotation angle by the rotation controlling means. Accordingly, when the supporting member is rotated, a rotation angle position of a point on each supporting shaft is permanently maintained. Therefore, the weft package, from which the weft is released, can be maintained at a desired position without providing the weft package with grasping mechanism.

The rotation controlling means may comprise a first planetary gear secured to the respective supporting shafts, a second planetary gear rotatably supported on the supporting member about an axis in parallel with the horizontal axis and meshing with the first planetary gear, and a sun gear secured to the post, meshing with the second planetary gear and having the same number of teeth as the first planetary gear has.

In such a construction, for example, when the supporting member is rotated counterclockwise, the second planetary gear, rotated with the supporting member, is rotated counterclockwise about its axis since the sun gear is fixed. Consequently, the first gear is rotated in a clockwise manner according to the rotation of the second planetary gear. The first planetary gear has the same number of the teeth as of the sun gear has. Therefore, the first gear has the same rotational angle about its axis as the supporting member has.

Alternatively, the rotation controlling means may comprises a rotary member supported on the stand about an eccentric axis in parallel with and the horizontal axis, a shaft member disposed on the rotary member corresponding to the respective supporting shaft and rotatably supported in conjunction with and spaced from the respective supporting shafts by the same interval as that between the horizontal axis and the eccentric axis, and a connecting member secured to the respective supporting shafts and the respective shaft members to connect each with the other.

According to such a construction, when the rotary member is rotated about the eccentric axis, the supporting member is rotated about the horizontal axis and accompanies the rotary member. At this time, the shaft member and the supporting shaft are provided with a mutual interval which is permanently maintained therebetween. And each draws a respectively different locus of rotation. Thus, the supporting shaft is rotated about its axis by the same angle of rotation as that of the supporting member.

It is possible to arrange the components so that the horizontal axis of the supporting member and the eccentric axis of the rotary member are disposed in a vertical plane, and the axes of the respective supporting shafts and the axes of the respective shaft members are disposed in a vertical plane in parallel with the above vertical plane.

The supporting member may include a plurality of extending portions, through which the supporting shaft is passed, which radially extends from the horizontal axis. The supporting member may include a plurality of extending portions each composed of a plurality of pieces which can be bent in the extending direction relative to the horizontal axis. Further, the extending portion may be provided with a cam member which engages the extending portions one by one at a predetermined rotational position when the supporting member is rotated, and causes the, extending portions to bend.

According to this aspect, the extending portions are bent to have substantially shorter radial lengths when bent. Thus, the supporting shaft passing through the extending portions receives a tensile force in the horizontal axial direction. Consequently, the supporting shaft is rotated about the axis of the shaft member corresponding to the supporting shaft. As a result, a position of a point on the supporting shaft is varied about the axis of the supporting shaft. Therefore, the weft package disposed at a position where the weft is not released can be, for example, directed to a yarn guide by forcedly changing the position of the supporting shaft.

Another weft stand according to the present invention comprises a post, a supporting member supported on the post and rotatable about a horizontal axis, a supporting shaft for each weft package, rotatably supported on the supporting member about an axis in parallel with the horizontal axis, a pedestal rotatably supported on the supporting shaft, and a heavy bob suspended from the pedestal.

According to the present invention, the heavy bob suspended from the pedestal carries a vertical force all the time. Therefore, the weft package provided on the pedestal can be maintained at a constant position irrespective of rotation of the supporting member.

BRIEF DESCRIPTION OF THE DRAWINGS

The foregoing and other objects and features of the invention will become apparent from the following description of preferred embodiments of the invention with reference to the accompanying drawings, in which.

DESCRIPTION OF THE PREFERRED EMBODIMENTS

Figure 1:
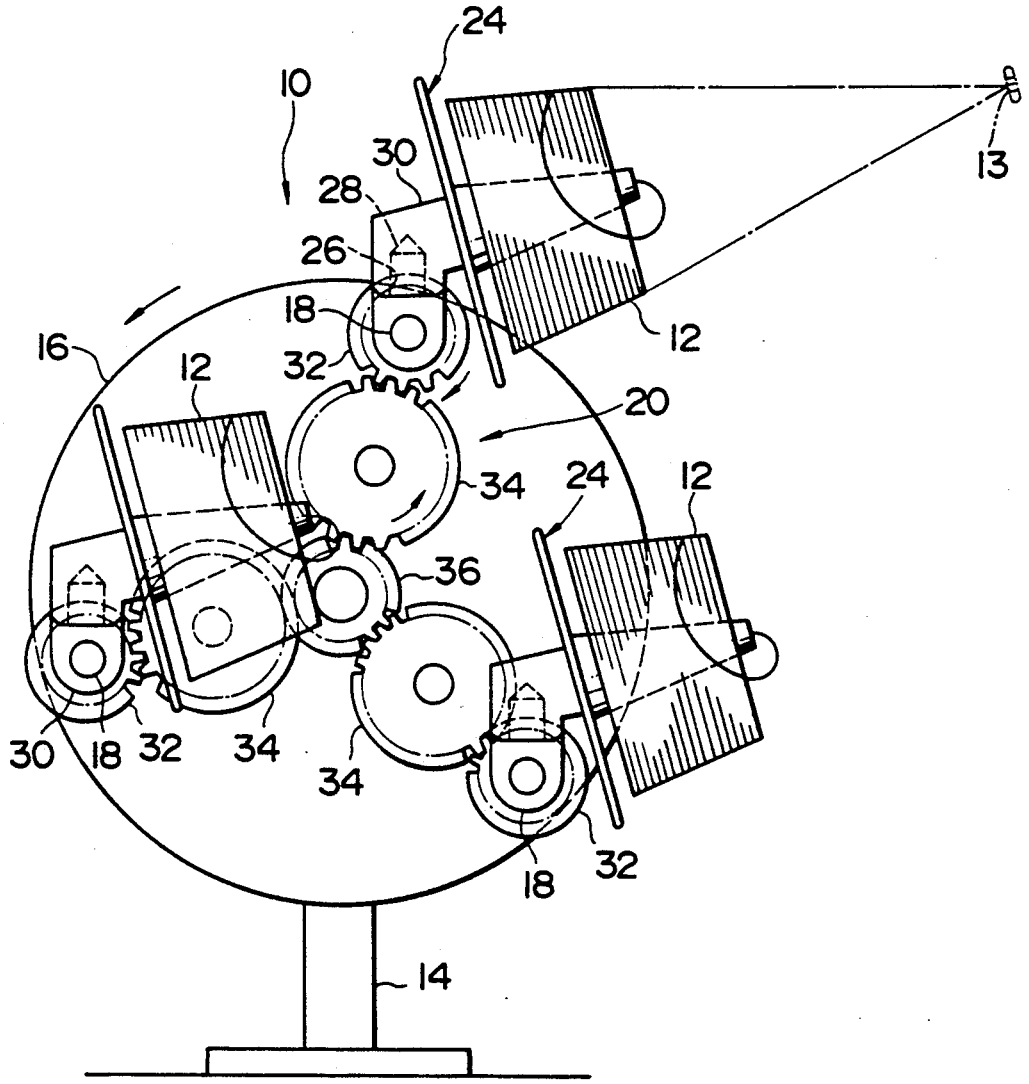
FIG. 1 is a front view of a weft stand according to the present invention.

Referring now to FIG. 1, an overall construction of a weft stand of the present invention is denoted by a reference numeral 10. The weft stand 10 holds a plurality of weft packages 12 (three packages are illustrated in the figure) to feed a weft to a weaving machine (not shown). The weft packages 12 are held at each position, i.e., a released position, an exchanging position, and a waiting position. As used herein, the term "released position" refers to a position to release the weft from the weft package. The term "exchanging position" refers to a position to exchange a weft package in which the weft is consumed for a new weft package. The term "waiting position" refers to a position where the weft package waits for further releasing the weft when the weft of the weft package is consumed. The weft is fed from the weft package 12 disposed at the released position through a yarn guide 13 to the weaving machine.

The weft stand 10 comprises a post 14, a supporting member 16 rotatably supported on the post 14 about a horizontal axis, a supporting shaft 18 for each weft package 12, rotatably supported on the supporting member 16 about an axis in parallel with the horizontal axis, and rotation controlling means 20 for rotating the supporting member 16 and each supporting shaft 18 in the respective opposite directions at each identical rotation angle.

Figure 2:
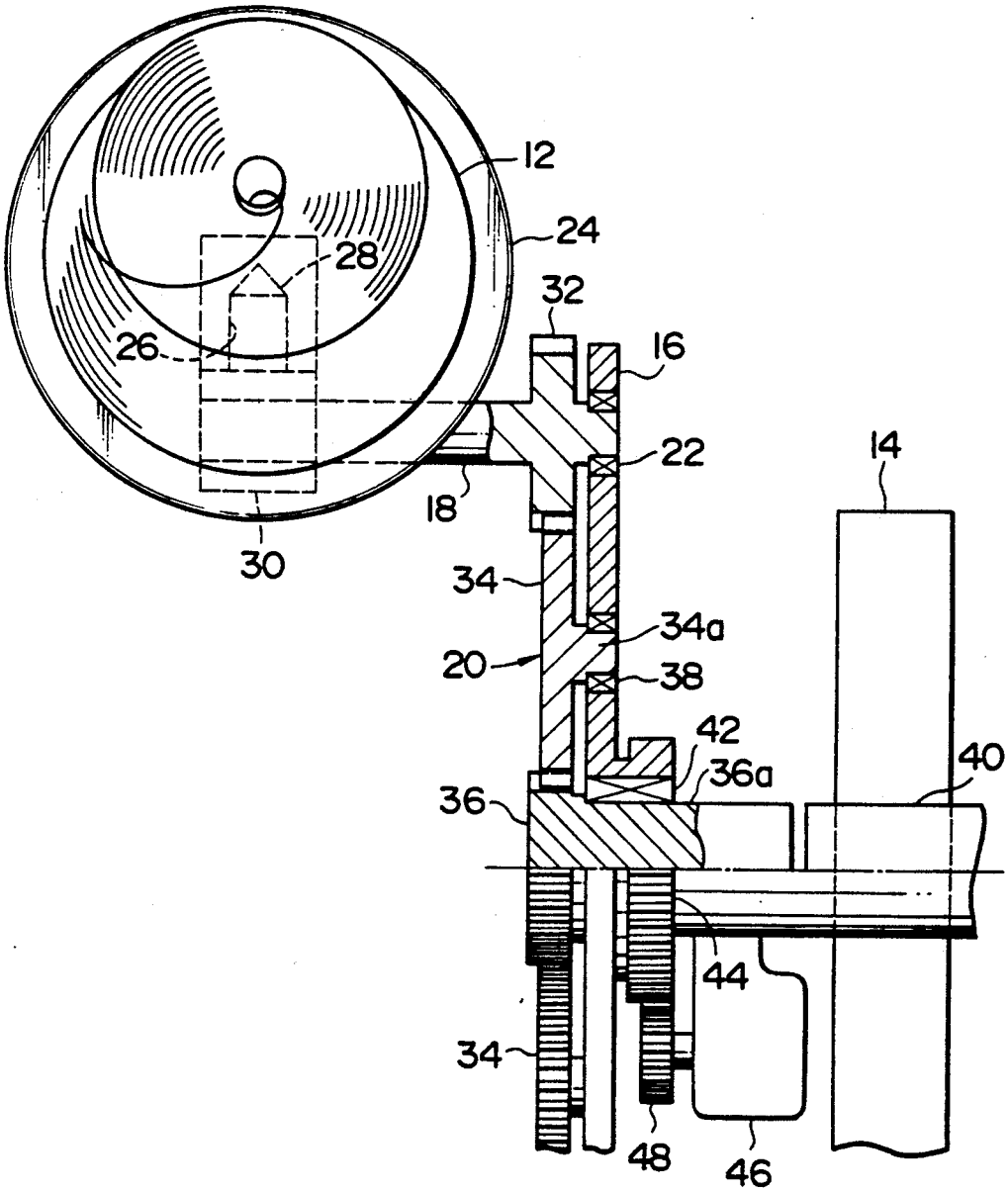
FIG. 2 is a sectional view, substantially enlarged, of the weft stand of FIG. 1.

As shown in FIGS. 1 and 2, the supporting member 16 comprises a disk. The three supporting shafts 18 are disposed in the vicinity of a circumference of the disk at the circumferential regular intervals therebetween to pass through the disk. Reference numeral 22 refers to a bearing for each supporting shaft 18.

A pedestal 30 is mounted on one end of the supporting shaft 18. The pedestal 30 has a pin 28 which can be inserted into a hole 26 of a tray 24 mounted on the weft package 12. According to a preferred embodiment as shown in FIGS. 1–4, the pin 28 is set to extend upwardly in the released position. Also, the tray 24, when fitted into the pin 28, directs the axis of the weft package 12, i.e., the axis of a bobbin toward the yarn guide 13.

The rotation controlling means 20 comprises a first planetary gear 32 secured to each supporting shaft 18, a second planetary gear 34 rotatably supported on the supporting member 16 about an axis in parallel with the horizontal axis and meshing with the first planetary gear 32, and a sun gear 36 secured to the post 14, meshing with the second planetary gear 34 and having the same number of teeth as that of teeth of the first planetary gear 32.

The first planetary gear 32 as shown in FIGS. 1 and 2 is disposed around the supporting shaft 18 and is integrally formed with the supporting shaft 18.

The second planetary gear 34 has a shaft portion **34*a* passing through the disk. A bearing 38 is disposed between the shaft portion 34*a* and the disk. Further, according to a preferred embodiment as shown in FIGS. 1 and 2, the second planetary gear 34 has more teeth than those of the first planetary gear 32**.

The sun gear 36 has a shaft portion **36*a* rigidly mounted on a mounting portion 40 which is secured to the post 14**.

The shaft portion **36*a* of the sun gear 36 passes through an intermediate portion of the disk 16. A bearing 42 is disposed between the shaft portion 36*a* and the disk 16. The disk 16 has a gear 44 which is integrally formed with the disk 16 and surrounds the bearing 42. The gear 44 meshes with a pinion 48 mounted on an output shaft of a motor 46 which is secured to the mounting portion 40**.

When the motor 46 is driven, the disk 16 is rotated about the shaft portion **36*a*, i.e., the horizontal axis. The second planetary gear 34 is rotated about the shaft portion 36*a* in conjunction with the disk 16, and meshes with the fixed sun gear 36. Accordingly, the second planetary gear 34 is rotated about the axis of the shaft portion 34*a*, i.e., an axis in parallel with the horizontal axis. A rotation angle of the disk 16 is equal to a value obtained by dividing a value, which is obtained by multiplying the rotation angle of the second planetary gear 34 by the number of teeth of the second planetary gear 34, by the number of teeth of the sun gear 36**.

Torque of the second planetary gear 34 is transmitted to the first planetary gear 32 meshing with the second planetary gear 34. The torque allows to rotate the first planetary gear 32 in conjunction with the supporting shaft 18. The first planetary gear 32 has the same number of teeth as that of teeth of the sun gear 36. Therefore, the first planetary gear 32 and the supporting shaft 18 have the same angle of rotation as that of the disk 16.

Hence, the position of the weft package 12 in the released position can be permanently maintained even in the exchanging position where the disk 16 is rotated counterclockwise substantially 120 degrees, as viewed in FIG. 1, and also can be so maintained even in the waiting position where the disk 16 is further rotated counterclockwise substantially 120 degrees. Further, the weft package 12 can be held at the same position while the disk is transferred between the respective positions. Therefore, when the disk 16 is rotated, the tray 24 can be held at the constant position where the tray 24 never slips off the pin 28.

Figure 3:
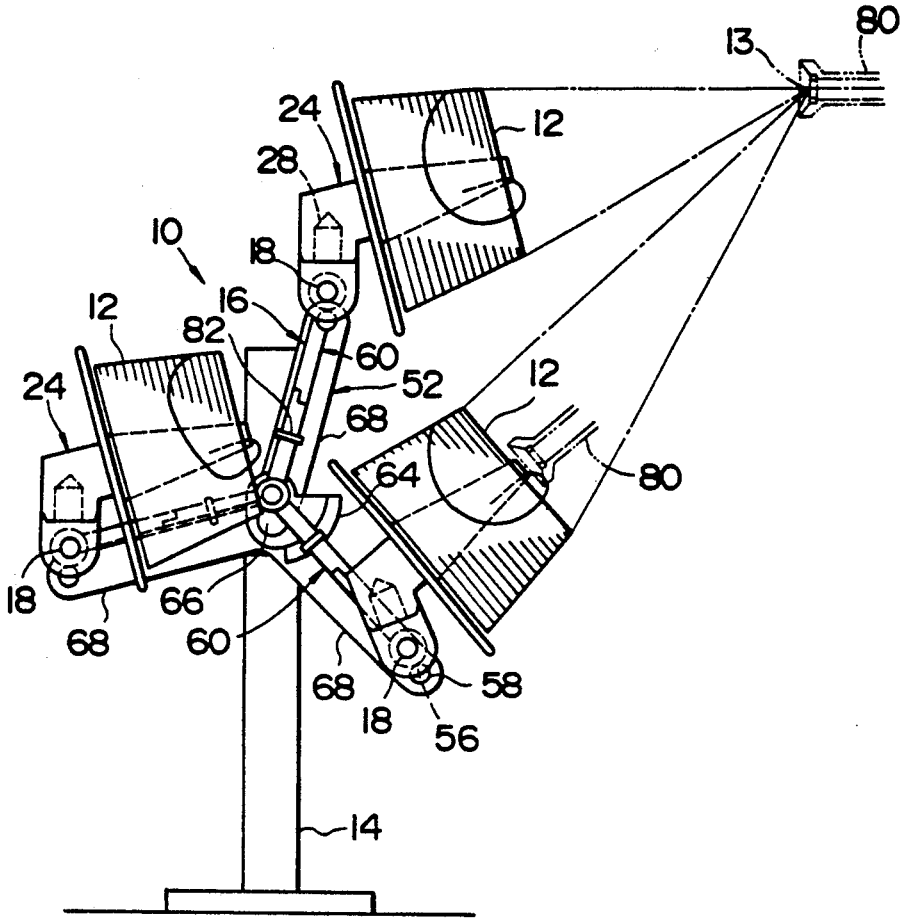
FIG. 3 is a front view of another weft stand according to the present invention.
Figure 4:
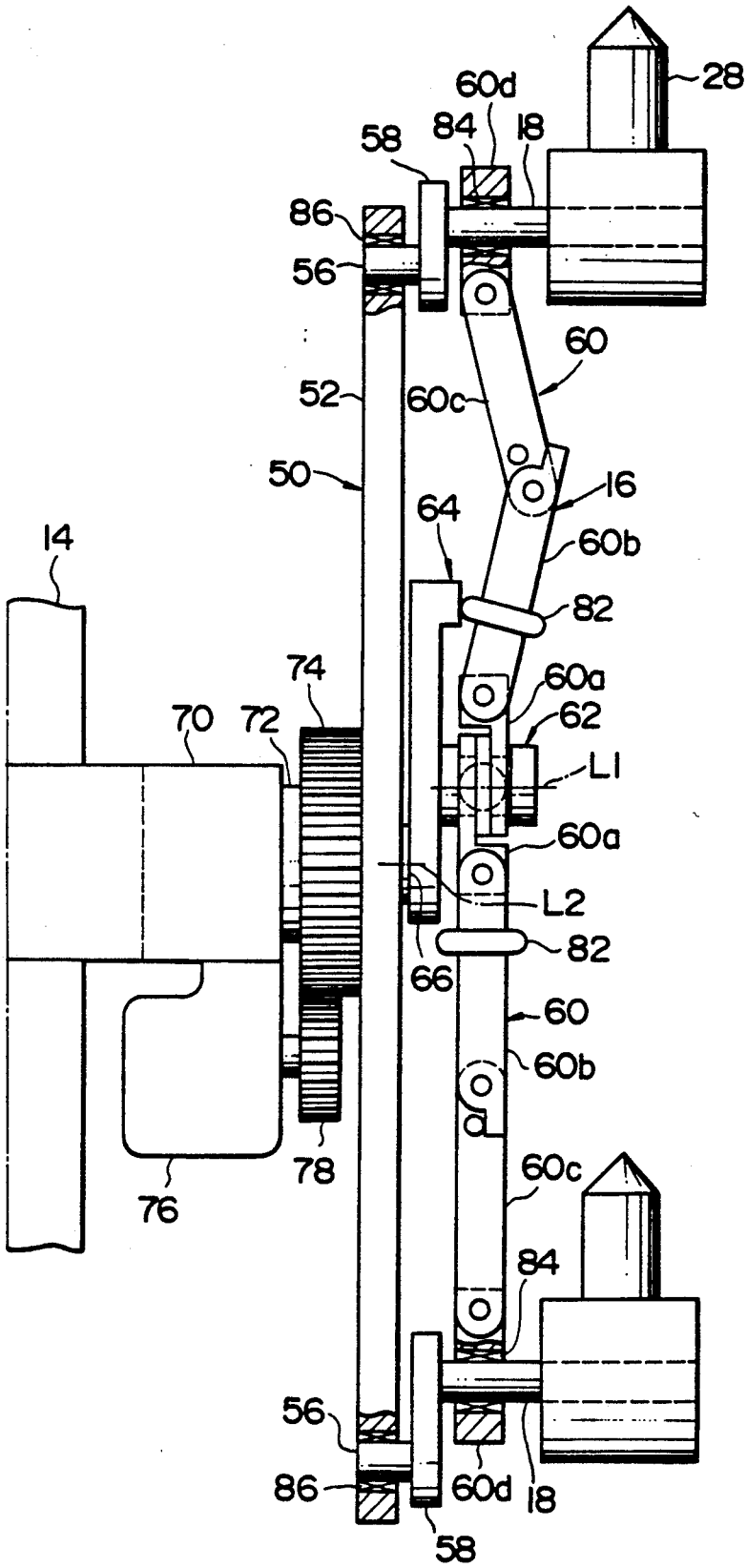
FIG. 4 is a sectional view, substantially enlarged, of the weft stand of FIG. 3.

Referring now to FIGS. 3 and 4, another embodiment of the rotation controlling means 50 is described hereinafter.

The rotation controlling means 50 comprises a rotary member 52 supported on the stand 14 for rotation about a horizontal axis, i.e., an eccentric axis L2 in parallel with a horizontal axis L1 of a supporting member 16, a shaft member 56 is rotatably supported on the rotary member 52 corresponding to each supporting shaft 18, the distance between an axis of each shaft member 56 and the corresponding shaft 18 being the same as that between the first and second horizontal axes L1 and L2.

According to the embodiment as shown in FIGS. 3 and 4, the axis L1 of the supporting member 16 is disposed above the axis L2 of the rotary member 52, and is arranged in a vertical plane perpendicular to the drawing as viewed in FIG. 3. Each axis of the supporting shaft 18 and the corresponding shaft member 56 is arranged in a vertical plane in parallel with the above vertical plane.

In this embodiment, the supporting member 16 has three extending portions 60 radially extending from the horizontal axis L1 to form isometric angles therebetween. Each extending portion 60 comprises four plate pieces 60*a* through 60*d* which are aligned with each other and are rockably connected with each other. The extending portion 60 can be bent in the direction of the axis L1. The supporting member 16 is mounted on the post 14 through a shaft 62, a cam member 64, and a shaft 66. The pieces 60*a* serving as the respective original ends of the three extending portions are fixed to each other. The shaft 62 passes through the pieces 60*a*. The cam member 64, as described later, is secured to the shaft 62. The shaft 66 of the rotary member 52 is secured to the cam member 64. Accordingly, the supporting member 16 can be rotated about the shaft 62.

The rotary member 52 has three extending portions 68 radially extending from the eccentric axis L2 to form isometric angles therebetween as in the case of the supporting member 16. Here, the three extending portions 68 comprises a single plate member.

A shaft 72 having a large diameter portion and a small diameter portion extends from a mounting member 70 secured to the post 14. The small diameter portion of the shaft 72 passes through a cross portion of the three extending portions 68 on the rotary member 52. Accordingly, the rotary member 52 can be rotated about the small diameter portion of the shaft 72. A gear 74 is rotatably disposed about the large diameter portion of the shaft 72, and is secured to the rotary member 52. The gear 74 meshes with a pinion 78 secured to an output shaft of a motor 76 which is mounted on the mounting member 70. Consequently, the rotary member 52 is rotated about the eccentric axis L2 in response to drive of the motor 76.

It is assumed that the rotary member 52 is rotated counterclockwise as viewed in FIG. 3. Thus, torque of the rotary member 52 is transmitted to the supporting member 16 through the shaft member 56, the connecting member 58 and the supporting shaft 18. Accordingly, the supporting member 16 can be rotated counterclockwise about the axis L1. Since the rotary member 52 and the supporting member 16 are rotated about each different axis, the shaft member 56 and the supporting shaft 18 draw each different circular locus. The shaft member 56 and the supporting shaft 18 connected with each other are rotated about each axis. The shaft member 56 and the supporting shaft 18 have the same rotation angle as that of the rotary member 52 and the supporting member 16. Thus, a point on a peripheral surface of the supporting shaft 18 can be permanently held about the axis of the supporting shaft 18 at any rotation angle. As a result, it is possible to maintain the position of the tray 24 and the directional position of the weft package 12 constant while the supporting member 16 is rotated. The tray 24 is supported by the supporting shaft 18 and the weft package 12 is secured to the tray.

With reference to FIG. 3, the weft package 12 disposed at the uppermost released position can be positioned toward the yarn guide 13. The position of the weft package 12 can be permanently maintained even in the exchanging position where the weft package 12 is rotated counterclockwise substantially 120 degrees, and even in the waiting position where the weft package 12 is further rotated counterclockwise substantially 120 degrees.

Meanwhile, in the weft package in the released position, an accident such as a broken thread may occur during weaving. Hence, a weft withdrawing apparatus including the yarn guide 13 may be moved toward the weft package 12 disposed in the waiting position to withdraw the weft from the weft package 12. In such a case, the weft package in the waiting position is preferably disposed toward the yarn guide 13. For this, each extending portion 60 of the supporting member 16 can be bent and is provided with the cam member 64. In the embodiment in FIGS. 3 and 4, the piece 60*b* includes a roller 82 which can engage the cam member 64.

The cam member 64 is disposed at a position corresponding to the waiting position, and is secured to one end of the small diameter portion of the shaft 72. Therefore, when the rotation of the extending portion 60 of the supporting member 16 is stopped at the waiting position, the roller 82 engages the cam member 64. The piece 60*b* having the roller 82 is rocked with respect to the adjacent piece 60*a*. Further, the rocked piece 60*b* causes the adjacent piece 60*c* to rock. The respective pieces 60*b* and 60*c* are rocked so that the radial length of the extending portion 60 having the pieces is substantially decreased. Accordingly, the supporting shaft 18 passing through the end piece 60*d* is rotated about the axis of the shaft 18 counterclockwise as viewed in FIG. 3. At this time, the vertical plane including each axis of the supporting shaft 18 and the corresponding shaft member 56 is turned into an inclined plane. A rotation angle of the supporting shaft 18 in this condition may be determined by considering the position of the yarn guide 13.

If the supporting member 16 is further rotated counterclockwise, the roller 82 is rolled on the cam member 64 and thereafter, the roller 82 is separated from the cam member 64. While the roller 82 leaves the cam member 64 and the supporting shaft 18 moves from the waiting position to the released position counterclockwise as viewed in FIG. 3, the shaft 18 is rotated counterclockwise by the weight of the package supported thereby. Therefore, the piece 60*d* receives a radially outward tensile force. As a result, the pieces 60*b* and 60*c* in a bent state are extended to be straight in said radial direction and returned to their original positions. Accordingly, the supporting shaft 18 and the shaft member 56 are rotated about each axis thereof. Instead of the roller 82, the piece 60*b* may have a projection. Reference numerals 84, 86 refer to bearings for the supporting shaft 18 and the shaft member 56, respectively.

Figure 5:
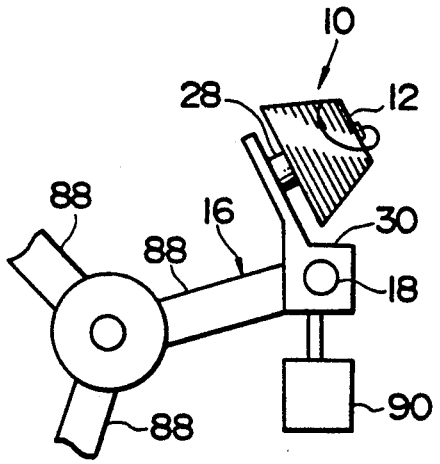
FIG. 5 is a partial front view of a further weft stand according to the present invention.

As shown in FIG. 5, the supporting member 16 may include three extending portions 88 as in the case of the extending portions 68 of the rotary member 52. A pedestal 30 is secured on the supporting shaft 18 mounted on each one end of the three extending portions 88. The pedestal 30 having the pin 28 may be provided with a heavy bob weight 90 suspended from the pedestal 30.

If the supporting member 16 is rotated counterclockwise by, for example, a motor, the heavy bob 90 is vertically attracted by gravity. Accordingly, the weft package 12 and the pedestal 30 are reversely rotated clockwise by the rotation angle of the supporting member 16 in conjunction with the supporting shaft 18. As a result, the weft package 12 can be permanently held in a constant position. The supporting shaft 18 may be secured to the supporting member 16 such that the pedestal 30 can be rotated about the supporting shaft 18. Alternatively, a motor (not shown) may be employed for another embodiment of the rotation controlling means, i.e., means for rotating the supporting shaft 18. More particularly, the single motor is provided on the supporting member 16. A motor shaft and the supporting shaft 18 are connected with each other such that the motor is rotated to rotate each supporting shaft 18 about each axis simultaneously. The rotation angle of the supporting member 16 is detected. Accordingly, the rotation of the motor may be controlled such that each supporting shaft 18 and the supporting member 16 are rotated in the respective opposite directions at the same rotation angle as the detected rotation angle.

What is claimed is:

1. A weft stand for holding a plurality of weft packages for the feed of a weft to a weaving machine comprising:

a post;

a supporting member supported on said post for rotation about a first horizontal axis;

a rotary member supported on said post for rotation about a second horizontal axis in parallel with said first horizontal axis;

a shaft for supporting each package, rotatably supported on said supporting member in parallel with said first horizontal axis;

a plurality of shaft members supported on the rotary member in parallel with said second horizontal axis, with each shaft member corresponding to each shaft, the distance between the axis of each shaft member and the axis of the corresponding shaft being the same as that between the first and second horizontal axes; and a connecting member connecting each said shaft member and each corresponding shaft so as to rotate each corresponding shaft about the axis of each said shaft member.

2. A weft stand according to claim 1, wherein said supporting member has a plurality of extending portions radially extending from said first horizontal axis, with a said shaft in each such radially extending portion, each such extending portion being composed of a plurality of pieces which can be bent, and said post being provided with a cam member engaged one by one by said extending portions at a predetermined rotational position when said supporting member is rotated, causing said extending portions to bend successively.

3. A weft stand for holding a plurality of weft packages for the feed of a weft to a weaving machine, comprising:

a post;

a supporting member supported on said post for rotation about a first horizontal axis;

a rotary member supported on said post for rotation about a second horizontal axis in parallel with said first horizontal axis;

a plurality of shafts supported on said supporting member for rotation about axes parallel to said first horizontal axis;

a plurality of shaft members supported on the rotary member parallel to said second horizontal axis, with each shaft member corresponding to each shaft, the distance between the axis of each shaft member and the axis of the corresponding shaft being the same as that between the first and second horizontal axes; and a connecting member for supporting each package, supported on each said shaft member so as to rotate about the axis of the shaft member and secured to the shaft to connect the shaft member and the shaft.

4. A weft stand for holding a plurality of weft packages for the feed of a weft to a weaving machine, comprising:

a post;

a supporting member supported for rotation on said post about a first horizontal axis;

a rotary member supported on said post for rotation about a second horizontal axis in parallel with said first horizontal axis;

a shaft for supporting each package, rotatably supported on said supporting member in parallel with said first horizontal axis;

a plurality of shaft members supported on the rotary member parallel to said second horizontal axis, with each shaft member corresponding to each shaft, the distance between each shaft member axis and each corresponding shaft axis being the same as that between the first and second horizontal axes, and the distance between the second horizontal axis and each shaft member axis being the same as that between the first horizontal axis and each shaft axis; and a connecting member supported on each said shaft member so as to rotate about the shaft member axis and secured to said shaft to connect said shaft member and said shaft.

5. A weft stand for holding a plurality of weft packages for the feed of a weft to a weaving machine, comprising:

a post;

a supporting member supported for rotation on said post about a first horizontal axis;

a rotary member supported on said post for rotation about a second horizontal axis in parallel with said first horizontal axis;

a plurality of shafts supported on said supporting member for rotation about axes parallel to said first horizontal axis;

a plurality of shaft members supported on the rotary member parallel to said second horizontal axis, with each shaft member corresponding to each shaft, the distance between the axis of each shaft member and the axis of the corresponding shaft being the same as that between the first and second horizontal axes, and the distance between the second horizontal axis and each of the shaft member axes being the same as that between the first horizontal axis and each of the shaft axes; and a connecting member for supporting each package, supported on each said shaft member, so as to rotate about the axis of said shaft member, and secured to said shaft to connect said shaft member and said shaft.

* * * * *